US011424064B2

(12) United States Patent
Imada

(10) Patent No.: US 11,424,064 B2
(45) Date of Patent: Aug. 23, 2022

(54) MULTILAYER COIL COMPONENT

(71) Applicant: Murata Manufacturing Co., Ltd., Kyoto-fu (JP)

(72) Inventor: Katsuhisa Imada, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 554 days.

(21) Appl. No.: 16/245,083

(22) Filed: Jan. 10, 2019

(65) Prior Publication Data

US 2019/0214182 A1 Jul. 11, 2019

(30) Foreign Application Priority Data

Jan. 11, 2018 (JP) ..... JP2018-002976

(51) Int. Cl.
*H01F 27/28* (2006.01)
*H01F 27/24* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC ..... H01F 17/0013; H01F 2027/2809; H01F 17/0006; H01F 27/2804; H01F 5/003; H01F 27/29; H01F 27/292; H01F 17/04; H01F 27/24; H01F 27/245; H01F 27/255; H01F 27/30; H01F 27/306; H01F 27/027; H01F 27/06; H01F 27/26; H01F 27/266
(Continued)

(56) References Cited

U.S. PATENT DOCUMENTS 8,242,870 B1 * 8/2012 Folker ..... H01F 27/255 336/198
10,796,837 B2 10/2020 Ito et al.
(Continued)

FOREIGN PATENT DOCUMENTS

CN 101356598 A 1/2009
CN 104078192 A 10/2014
(Continued)

OTHER PUBLICATIONS

An Office Action; "Notification of Reasons for Refusal," mailed by the Japanese Patent Office dated Apr. 7, 2020, which corresponds to Japanese Patent Application No. 2018-002978 and is related to U.S. Appl. No. 16/245,083 with English language translation.
(Continued)

*Primary Examiner* — Tszfung J Chan
(74) *Attorney, Agent, or Firm* — Studebaker & Brackett PC

(57) ABSTRACT

A multilayer coil component includes a body including laminated ferrite layers, a coil conductor including conductive layers laminated in the body, and a pair of outer electrodes disposed on the lower surface of the body. Each of the pair of outer electrodes is electrically connected to a corresponding one of the end portions of the coil conductor. The lower surface of the multilayer coil component includes a recessed section between the pair of outer electrodes.

19 Claims, 10 Drawing Sheets

(51) Int. Cl.

| | |
|---|---|
| ***H01F 41/04*** | (2006.01) |
| ***H01F 27/29*** | (2006.01) |
| ***H01F 17/00*** | (2006.01) |
| ***H01F 17/04*** | (2006.01) |

(52) U.S. Cl.
CPC ..... *H01F 27/24* (2013.01); *H01F 27/29* (2013.01); *H01F 27/292* (2013.01); *H01F 41/041* (2013.01); *H01F 41/043* (2013.01); *H01F 41/046* (2013.01); *H01F 2027/2809* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 2008/0038562 | A1 | 2/2008 | Ito et al. | |
| 2009/0115563 | A1* | 5/2009 | Arata | H01F 17/0013 336/200 |
| 2011/0279213 | A1* | 11/2011 | Tsuduki | H01F 17/0013 336/200 |
| 2013/0257576 | A1* | 10/2013 | Arata | H01F 17/0013 336/200 |
| 2014/0078643 | A1 | 3/2014 | Odahara | |
| 2014/0292466 | A1 | 10/2014 | Watanabe et al. | |
| 2015/0145629 | A1* | 5/2015 | Chang | H01F 17/0006 336/192 |
| 2015/0294780 | A1 | 10/2015 | Maeda | |
| 2016/0086720 | A1* | 3/2016 | Jeong | H01F 27/292 336/200 |
| 2016/0351314 | A1* | 12/2016 | Jeong | H01F 27/292 |
| 2017/0103845 | A1 | 4/2017 | Nagai et al. | |
| 2017/0150606 | A1* | 5/2017 | Yoon | H01F 17/0013 |
| 2018/0182536 | A1 | 6/2018 | Tachibana | |
| 2018/0350505 | A1* | 12/2018 | Ryu | H01F 17/04 |
| 2020/0075228 | A1 | 3/2020 | Jeong | |
| 2020/0082986 | A1* | 3/2020 | Yaso | H01F 41/04 |

FOREIGN PATENT DOCUMENTS

| | | | | |
|---|---|---|---|---|
| CN | 104737245 | A | 6/2015 | |
| CN | 106205972 | A | 12/2016 | |
| CN | 108305760 | A | 7/2018 | |
| JP | 2005-026312 | A | 1/2005 | |
| JP | 2010-278133 | A | 12/2010 | |
| JP | 2011-009391 | A | 1/2011 | |
| JP | 2013-211302 | A | 10/2013 | |
| JP | 2014-150096 | A | 8/2014 | |
| JP | 2017-073495 | A | 4/2017 | |
| WO | 2008/018187 | A1 | 2/2008 | |
| WO | WO-2008018187 | A1 * | 2/2008 | B32B 27/30 |
| WO | 2012-172939 | A1 | 12/2012 | |
| WO | WO-2012172939 | A1 * | 12/2012 | H01F 27/29 |
| WO | 2017/212990 | A1 | 12/2017 | |

OTHER PUBLICATIONS

An Office Action; "Notification of Reasons for Refusal," mailed by the Japanese Patent Office dated Apr. 7, 2020, which corresponds to Japanese Patent Application No. 2018-002977 and is related to U.S. Appl. No. 16/245,083 with English language translation.

An Office Action issued by the China National Intellectual Property Administration dated Oct. 28, 2020, which corresponds to Chinese Patent Application No. 201910018851.1 and is related to U.S. Appl. No. 16/245,083 with English language translation.

An Office Action issued by the China National Intellectual Property Administration dated Jul. 21, 2020, which corresponds to Chinese Patent Application No. 201910018639.5 and is related to U.S. Appl. No. 16/245,083 with English language translation.

An Office Action; "Notification of Reasons for Refusal," mailed by the Japanese Patent Office dated Apr. 7, 2020, which corresponds to Japanese Patent Application No. 2018-002976 and is related to U.S. Appl. No. 16/245,083 with English language translation.

* cited by examiner

MULTILAYER COIL COMPONENT

CROSS-REFERENCE TO RELATED APPLICATION

This application claims benefit of priority to Japanese Patent Application No. 2018-002976, filed Jan. 11, 2018, the entire content of which is incorporated herein by reference.

BACKGROUND

Technical Field

The present disclosure relates to a multilayer coil component.

Background Art

Multilayer coil components including electrodes disposed on their lower surfaces are known as multilayer coil components suitable for surface mounting. For example, Japanese Unexamined Patent Application Publication No. 2011-9391 discloses a multilayer coil component including a multilayer body in which insulating layers having a substantially rectangular shape are laminated, a coil disposed in the multilayer body, and outer electrodes disposed on the lower surface of the multilayer body.

A multilayer coil component is usually sealed with a resin when mounted on a substrate or the like. If the lower surface is substantially flat, the resin does not successfully enter a portion of the lower surface between outer electrodes to cause air to remain therebetween, thereby forming a void, in some cases. The presence of the void may cause various problems such as a decrease in the strength of the multilayer coil component.

SUMMARY

Accordingly, the present disclosure provides a multilayer coil component in which when the multilayer coil component is sealed with a resin, a void is less likely to be formed therein.

The inventor has conducted intensive studies in order to solve the foregoing problems and has found the following: in a multilayer coil component including a pair of outer electrodes on its lower surface, the formation of a recessed section between the pair of outer electrodes improves the entry of a resin when a multilayer coil component is sealed with a resin by potting, so that a void is less likely to be formed therein.

According to preferred embodiments of the present disclosure, a multilayer coil component includes a body including laminated ferrite layers, a coil conductor including conductive layers laminated in the body, and a pair of outer electrodes disposed on a lower surface of the body. Each of the pair of outer electrodes is electrically connected to a corresponding one of end portions of the coil conductor, in which the lower surface of the multilayer coil component includes a recessed section between the pair of outer electrodes.

According to preferred embodiments of the present disclosure, a method for producing a multilayer coil component including a body including laminated ferrite layers, a coil conductor including conductive layers laminated in the body, the conductive layers being connected through a connection conductor, and a pair of outer electrodes disposed on a lower surface of the body. Each of the pair of outer electrodes is electrically connected to a corresponding one of end portions of the coil conductor. The method further includes forming a first conductive paste layer with a first conductive paste and forming a second conductive paste layer with a second conductive paste on the first conductive paste layer to form a stacked conductive paste layer in which the first conductive paste layer and the second conductive paste layer are stacked, forming a ferrite paste layer with a ferrite paste on the conductive paste layer, and forming another first conductive paste layer with the first conductive paste on the ferrite paste layer and forming another second conductive paste layer with the second conductive paste on the another first conductive paste layer to form another stacked conductive paste layer in which the another first conductive paste layer and the another second conductive paste layer are stacked, in which the first conductive paste and the second conductive paste have different shrinkages when fired.

Other features, elements, characteristics and advantages of the present disclosure will become more apparent from the following detailed description of preferred embodiments of the present disclosure with reference to the attached drawings.

DETAILED DESCRIPTION

Figure 1:
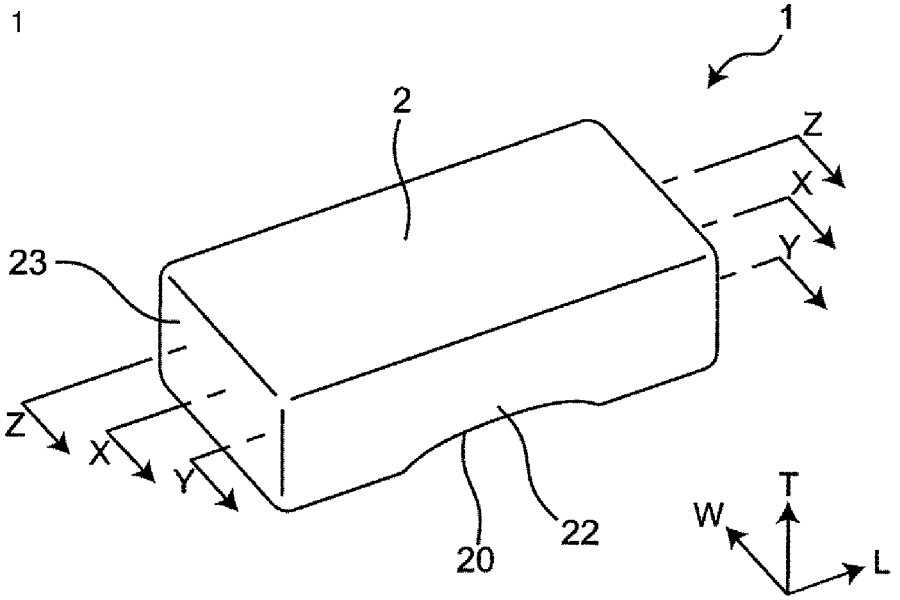
FIG. 1 is a perspective view of a multilayer coil component according to an embodiment of the present disclosure.

A multilayer coil component and a method for producing the multilayer coil component disclosed in this specification will be described below with reference to the attached drawings. It should be noted, however, that the structure, shape, number of turns, relative positions, and the like of the multilayer coil component of the present disclosure are not limited to the examples illustrated in the drawings.

Figure 2:
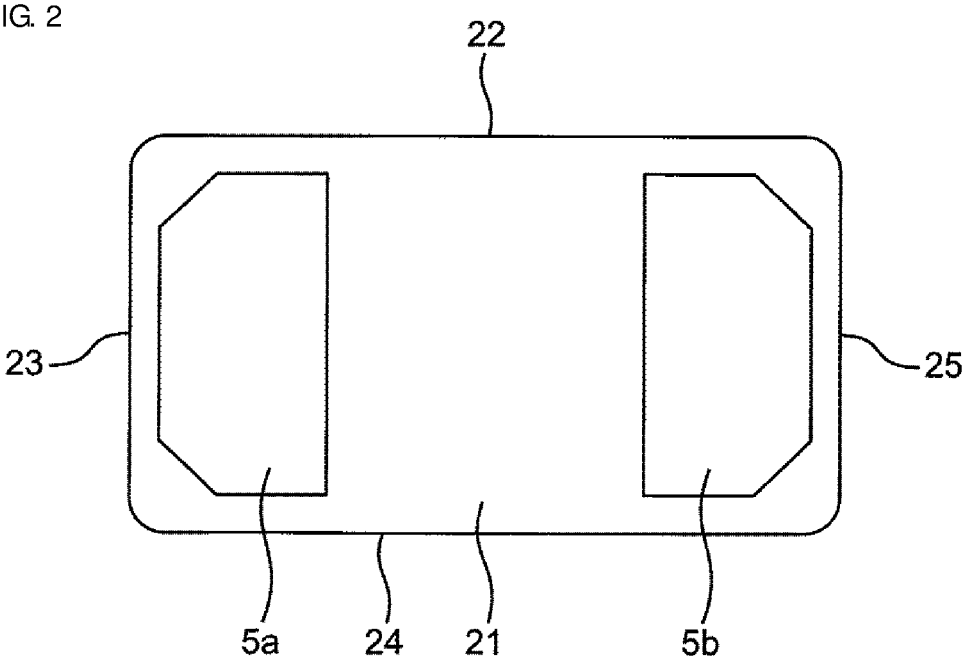
FIG. 2 is a bottom view of the multilayer coil component according to the embodiment illustrated in FIG. 1.
Figure 3:
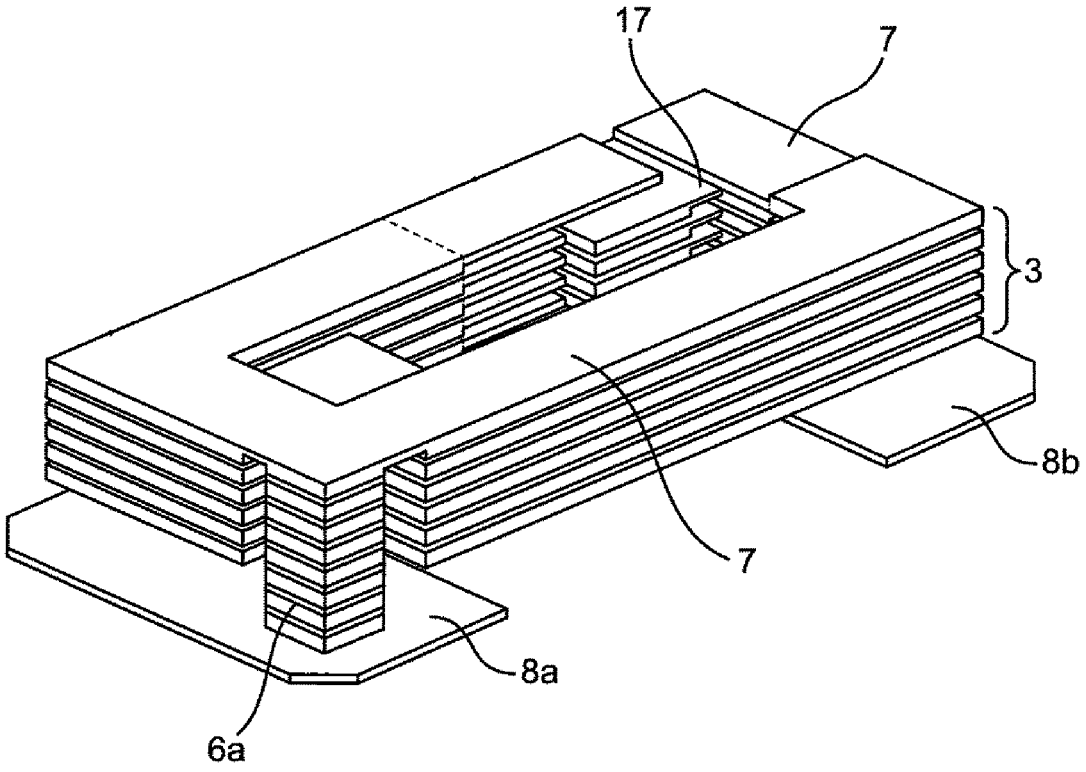
FIG. 3 is a perspective view illustrating the coil conductor, the lead electrode, and underlying electrodes of the multilayer coil component according to the embodiment illustrated in FIG. 1.
Figure 4:
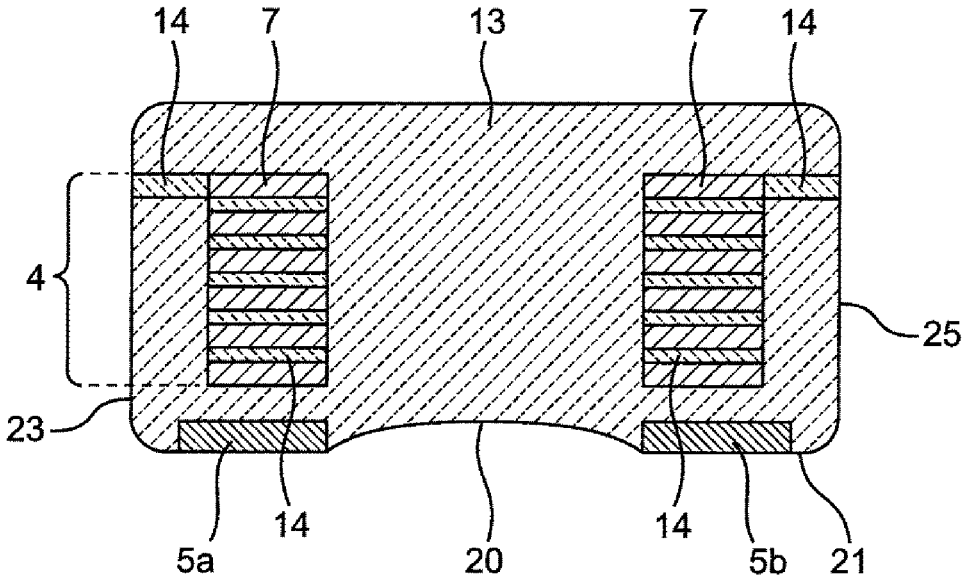
FIG. 4 is a cross-sectional view of the multilayer coil component according to the embodiment illustrated in FIG. 1, the cross-sectional view being taken along line X-X of FIG. 1.
Figure 5:
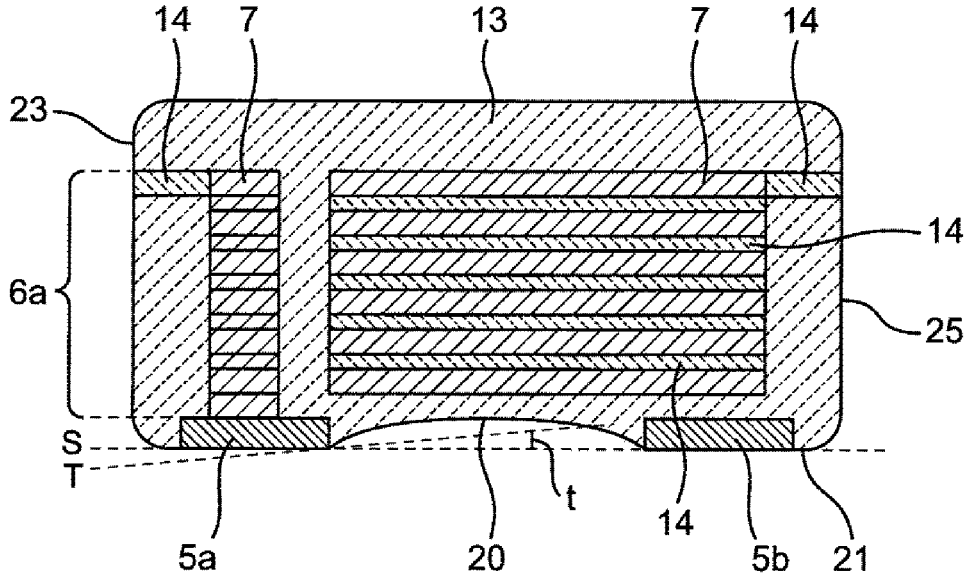
FIG. 5 is a cross-sectional view of the multilayer coil component according to the embodiment illustrated in FIG. 1, the cross-sectional view being taken along line Y-Y of FIG. 1.
Figure 6:
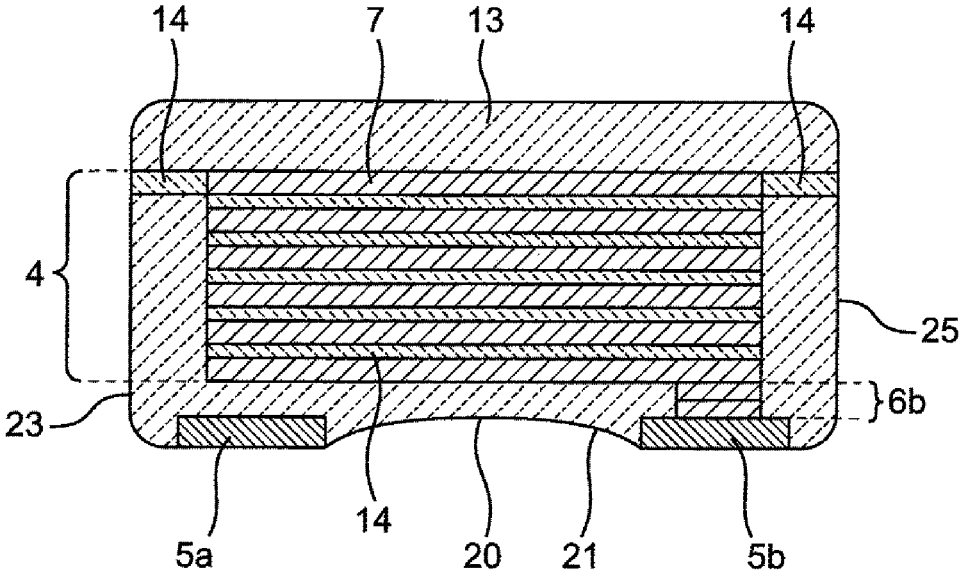
FIG. 6 is a cross-sectional view of the multilayer coil component according to the embodiment illustrated in FIG. 1, the cross-sectional view being taken along line Z-Z of FIG. 1.

As illustrated in FIGS. 1 to 6, the multilayer coil component 1 according to this embodiment roughly includes a body 2, a coil conductor 3 embedded in the body 2, and a pair of outer electrodes 5*a* and 5*b* disposed on the lower surface 21 (for example, a surface on the lower side of FIG. 4) of the body 2. As illustrated in FIG. 3, the coil conductor 3 includes the conductive layers 7 that are laminated in the body 2 and that are connected together in the form of a coil. The outer electrodes 5*a* and 5*b* are located at the respective end portions of the lower surface 21. As illustrated in FIGS. 5 and 6, one end portion of the coil conductor 3 is electrically connected to the outer electrode 5*a* through a lead electrode 6*a*, and the other end portion of the coil conductor 3 is electrically connected to the outer electrode 5*b* through a lead electrode 6*b*. The lower surface 21 includes a recessed section 20 between the outer electrodes 5*a* and 5*b*.

The body 2 is formed of a multilayer ferrite body and includes magnetic ferrite layers (hereinafter, also referred to as "magnetic layers") 13 and non-magnetic ferrite layers (hereinafter, also referred to as "non-magnetic layers") 14. Hereinafter, the magnetic ferrite layers and the non-magnetic ferrite layers are collectively referred to as "ferrite layers".

The non-magnetic ferrite layers 14 are disposed between vertically adjacent conductive layers 7 in the body 2. That is, the conductive layer 7, the non-magnetic ferrite layer 14, and the conductive layer 7 are laminated in this order. The non-magnetic ferrite layers 14 are interposed between the conductive layers 7. The arrangement of the non-magnetic ferrite layers 14 between the conductive layers 7 as described above results in the blockage of magnetic flux passing through a region around the conductive layers 7; thus, the multilayer coil component has improved direct current superposition characteristics.

One of the non-magnetic ferrite layers 14 in the body 2 is disposed at the outer side portion of the uppermost layer, i.e., the layer disposed at the top in FIG. 4, of the conductive layers 7. In other words, the non-magnetic ferrite layer 14 is disposed between the conductive layers 7 and the side surfaces of the body 2. The non-magnetic ferrite layer 14 disposed at the position is disposed at the entire portion located between the uppermost layer of the conductive layers 7 and the side surfaces 22, 23, 24, and 25 of the body 2. The non-magnetic ferrite layer 14 vertically partitions the magnetic ferrite layers 13 at the outer side portion of the winding section 4 of the coil conductor 3. As described above, the non-magnetic ferrite layer 14 is disposed at the outer side portion of the winding section 4 of the coil conductor 3 and in the entire portion located between the coil conductor 3 and the side surfaces of the body 2, so that the magnetic flux of the coil conductor 3 can be blocked. Thus, the multilayer coil component has improved direct current superposition characteristics. Here, the term "winding section" refers to a section where the conductive layers of the coil conductor are wound in the form of a coil.

The magnetic ferrite layers 13 are disposed at a portion of the body 2 other than a portion where the non-magnetic ferrite layers 14 are disposed. In other words, the inner side portion of the winding section 4 of the coil conductor 3 is occupied by the magnetic ferrite layers 13. Because the inner side portion of the winding section 4 of the coil conductor is formed of the magnetic ferrite layers 13, the multilayer coil component can have increased inductance.

The lower surface 21 of the body 2 has the recessed section 20 between the pair of outer electrodes 5*a* and 5*b*. In the multilayer coil component 1, the presence of the recessed section 20 of the lower surface between the outer electrodes 5*a* and 5*b* can improve the entry of a potting resin, thereby inhibiting the formation of a void.

The recessed section 20 preferably has a depth of about 0.01 mm or more and about 0.10 mm or less (i.e., from about 0.01 mm to about 0.10 mm), more preferably about 0.03 mm or more and about 0.08 mm or less (i.e., from about 0.03 mm or more and about 0.08 mm).

The depth of the recessed section 20 can be measured as described below.

A sample of the multilayer coil component is vertically placed. The sample is sealed with a resin in such a manner that an LT side surface, for example, the side surface 22, is exposed.

The sample is polished with a polishing machine to a depth of about ½ of the width of the sample in the W direction to expose an LT section.

The polished surface of the sample is photographed with a scanning electron microscope (SEM).

A reference line connecting lower portions (lowermost portions) of the outer electrodes 5*a* and 5*b* is drawn. The largest distance between the reference line and the lower surface 21 of the body is measured. The distance is defined as the depth of the recessed section. The recessed section 20 preferably has a tapered portion. The tapered portion preferably has a taper angle of about 3° or more and about 10° or less (i.e., from about 3° to about 10°), more preferably about 4° or more and about 8° or less (i.e., from about 4° to about 8°).

The tapered portion can be measured as described below.

As with the case of measuring the depth of the recessed section, a sample of the multilayer coil component is vertically placed. The sample is sealed with a resin in such a manner that an LT side surface, for example, the side surface 22, is exposed.

The sample is polished with a polishing machine to a depth of about ½ of the width of the sample in the W direction to expose an LT section.

The polished surface of the sample is photographed with a scanning electron microscope (SEM).

As illustrated in FIG. 5, a reference line S connecting lower portions (lowermost portions) of the outer electrodes 5*a* and 5*b* is drawn. A tangent T to the peripheral wall surface of the recessed section is drawn at the point of intersection of the reference line S and the edge of the recessed section between the outer electrodes 5*a* and 5*b*. An angle t between the reference line and the tangent is measured and defined as the taper angle.

The magnetic ferrite layers 13 may be composed of a material such as, but not particularly limited to, sintered ferrite mainly containing Fe, Zn, Cu, and Ni. The non-magnetic ferrite layers 14 may be composed of a material such as, but not particularly limited to, sintered ferrite mainly containing Fe, Cu, and Zn.

While the body 2 includes the magnetic ferrite layers 13 and the non-magnetic ferrite layers 14 in this embodiment, the present disclosure is not limited to the embodiment. The body 2 may be formed of laminated ferrite layers. For example, the body 2 may be formed of the magnetic ferrite layers 13, none of the non-magnetic ferrite layers 14 being present in the body 2.

The coil conductor 3 includes the conductive layers 7 laminated in the body 2 in the form of a coil, the conductive layers 7 being connected through connection conductors 17.

One end portion of the coil conductor 3 is located at the upper side portion of the body 2. In other words, the one end portion is adjacent to a surface opposite to the surface on which the outer electrodes are disposed. The other end portion is located at the lower side portion of the body 2. In other words, the other end portion is adjacent to the surface on which the outer electrodes are disposed. The coil conductor 3 is formed in such a manner that the axis of the coil extends in the lamination direction of the body (vertical direction in FIG. 4).

The conductive layers 7 may be composed of any conductive material containing a conductive metal and is preferably composed of a conductive material mainly containing Cu or Ag, more preferably a conductive material mainly containing Ag. For example, the conductive layers are composed of a conductive material having a conductive metal content of about 98.0% by mass to about 99.9% by mass.

Figure 7:
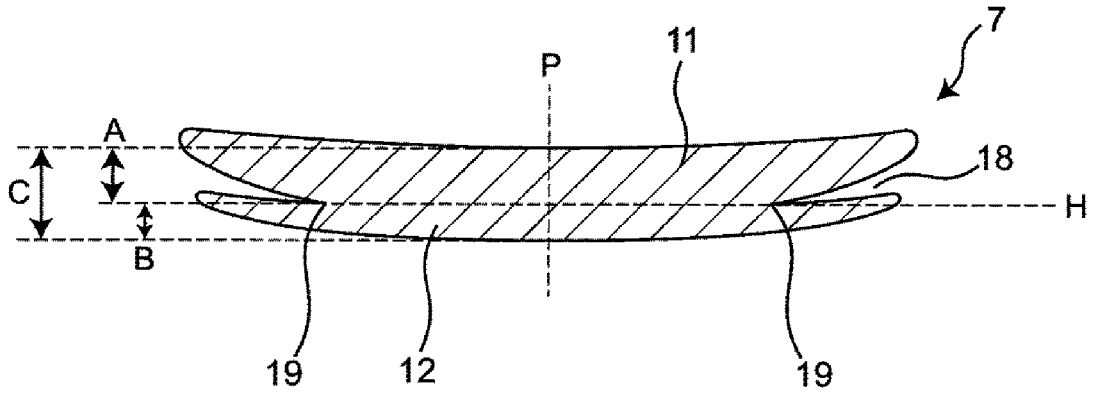
FIG. 7 is an enlarged sectional view of conductive layers of the multilayer coil component according to the embodiment illustrated in FIG. 1.

As illustrated in FIG. 7, each of the conductive layers 7 according to an embodiment includes a first conductive layer 11 and a second conductive layer 12. Because each of the conductive layers 7 is formed by separately forming the two layers, stresses applied to the respective first conductive layer 11 and the second conductive layer 12 are low, compared with when a single conductive layer having a thickness equal to the total thickness of the two layers is formed. This can suppress the occurrence of cracking in the body 2.

According to an embodiment, the second conductive layer 12 has a smaller thickness than the first conductive layer 11. The first conductive layer 11 and the second conductive layer 12 have different thicknesses. Thus, even if cracking occurs in the body, a crack is generated in the first conductive layer 11 to which a greater stress is applied, propagates toward the thin second conductive layer 12, and stops propagating at the boundary with the second conductive layer 12, thereby being able to inhibit failure due to the occurrence of cracking.

At least one of the conductive layers 7 according to an embodiment has constricted portions at their end portions. The shape of the constricted portions is preferably, but not necessarily, a substantially wedge shape.

At least one of the conductive layers 7 according to an embodiment has the constricted portions between the first conductive layer 11 and the second conductive layer 12. In each of the conductive layers 7 according to a preferred embodiment, the thin second conductive layer 12 is disposed on the side of the lower surface on which the outer electrodes are disposed.

The thickness of each of the conductive layers 7 is preferably, but not necessarily, about 15 μm or more and 45 μm or less (i.e., from about 15 μm to 45 μm), more preferably about 20 μm or more and about 40 μm or less (i.e., from about 20 μm to about 40 μm). When each of the conductive layers 7 is formed of the first conductive layer 11 and the second conductive layer 12, the thicker first conductive layer 11 preferably has a thickness of about 55% or more and about 70% or less (i.e., from about 55% to about 70%), more preferably about 55% or more and about 65% or less (i.e., from about 55% to about 65%) of the overall thickness of the conductive layer 7.

The thicknesses of the conductive layers 7, the first conductive layer 11, and the second conductive layer 12 can be measured as described below.

As with the case of measuring the depth of the recessed section, a sample of the multilayer coil component is vertically placed. The sample is sealed with a resin in such a manner that an LT side surface, for example, the side surface 22, is exposed.

The sample is polished with a polishing machine to a depth of about ½ of the width of the sample in the W direction to expose an LT section.

The polished surface of the sample is photographed with a scanning electron microscope (SEM).

As illustrated in FIG. 7, end portions 19 of the wedge-shaped constricted portions 18 located between the laminated first and second conductive layers 11 and 12 and at the left and right portions of the laminated first and second conductive layers 11 and 12 are connected with a line to provide reference line H. Perpendicular bisector P of a segment of reference line H between the end portions 19 is drawn. Distances between reference line H and a surface of the first conductive layer 11 and between reference line H and a surface of the second conductive layer 12 are measured. Specifically, length A and length B illustrated in FIG. 7 are measured.

Length A between the reference line H and the surface of the first conductive layer 11 is defined as the thickness of the first conductive layer 11. Length B between the reference line H and the surface of the second conductive layer 12 is defined as the thickness of the second conductive layer 12. Total thickness C of the first conductive layer 11 and the second conductive layer 12 is defined as the thickness of each of the conductive layers 7.

According to an embodiment, the first conductive layer 11 has a higher pore area percentage than the second conductive layer 12. The use of an electrode portion having a high pore area percentage can reduce stress concentration. When the first conductive layer 11 has a higher pore area percentage than the second conductive layer 12, the thin second conductive layer 12 is relatively dense, thus suppressing an increase in direct-current resistance.

According to an embodiment, the second conductive layer 12 preferably has a pore area percentage of about 1% or more and about 5% or less (i.e., from about 1% to about 5%), more preferably about 1% or more and about 4% or less (i.e., from about 1% to about 4%). The first conductive layer 11 preferably has a pore area percentage of about 3% or more and about 8% or less (i.e., from about 3% to about 8%), more preferably about 4% or more and about 6% or less (i.e., from about 4% to about 6%).

The pore area percentage can be measured as described below.

As with the case of measuring the depth of the recessed section, a sample of the multilayer coil component is vertically placed. The sample is sealed with a resin in such a manner that an LT side surface, for example, the side surface 22, is exposed.

The sample is polished with a polishing machine to a depth of about ½ of the width of the sample in the W direction to expose an LT section.

The polished surface of the sample is photographed with a scanning electron microscope (SEM).

As illustrated in FIG. 7, the end portions 19 of the wedge-shaped constricted portions 18 located between the laminated first and second conductive layers 11 and 12 and at the left and right portions of the laminated first and second conductive layers 11 and 12 are connected with a line to provide reference line H. Reference line H is defined as the boundary between first conductive layer 11 and the second conductive layer 12.

All the regions of the first conductive layer 11 and the second conductive layer 12 in the resulting SEM image are analyzed using image analysis software such as Azo-kun (registered trademark) available from Asahi Kasei Engineering Corporation. For each of the first conductive layer 11 and the second conductive layer 12, the percentage of area occupied by pores with respect to the total area is determined and defined as the pore area percentage.

According to an embodiment, at least one of the first conductive layer 11 and the second conductive layer 12 is curved in a substantially arc shape. According to a preferred embodiment, each of the first conductive layer 11 and the second conductive layer 12 is curved in a substantially arc shape. Each of the curved first and second conductive layers 11 and 12 preferably has a substantially convex surface facing toward the lower surface on which the outer electrodes are disposed.

The outer electrodes 5*a* and 5*b* are located on the respective left and right end portions of the lower surface 21. The outer electrodes 5*a* and 5*b* are electrically connected to the respective end portions of the coil conductor 3 through the respective lead electrodes 6*a* and 6*b*.

In this embodiment, each of the outer electrodes 5*a* and 5*b* is formed of a respective underlying electrode 8*a* and 8*b*, which are collectively referred to as electrode or electrodes 8 herein, and a plating layer 9 disposed thereon. In this disclosure, the plating layer 9 is not indispensable. Specifically, the outer electrodes 5*a* and 5*b* may be the underlying electrodes 8 that have no plating layer.

The underlying electrodes 8 are preferably disposed at a distance from the side surfaces of the body 2. When the multilayer coil component 1 is viewed in plan from the lower surface, portions of the lower surface 21 of the body 2 that is not covered with the underlying electrodes are provided around the underlying electrodes 8. The underlying electrodes 8 are disposed at a distance from the side surfaces of the multilayer coil component 1 as just described. This can suppress the peeling-off of the underlying electrodes 8 due to impact or the like.

The distance between the underlying electrodes 8 and the side surfaces of the body 2 (hereinafter, also referred to as a "side-gap distance") may be preferably, but not necessarily, about 5 μm or more and about 100 μm or less (i.e., from about 5 μm to about 100 μm), more preferably about 20 μm or more and about 80 μm or less (i.e., from about 20 μm to about 80 μm).

According to an embodiment, the underlying electrodes 8 have a shape in which portions of the underlying electrodes 8 close to corner portions of the body 2 are cut off when viewed in plan from the lower surface. Because the underlying electrodes have the shape in which the portions thereof close to the corner portions of the body are cut off, even if the corner portions of the body are scraped during barreling, the exposure of the outer electrodes at the side surfaces can be inhibited.

According to an embodiment, the underlying electrodes 8 have a substantially hexagonal shape in which two corner portions of a substantially rectangle shape are cut off as illustrated in FIGS. 2 and 3. The underlying electrodes 8 are arranged in such a manner that the cut-off portions face the corner portions of the body 2.

Figure 8:
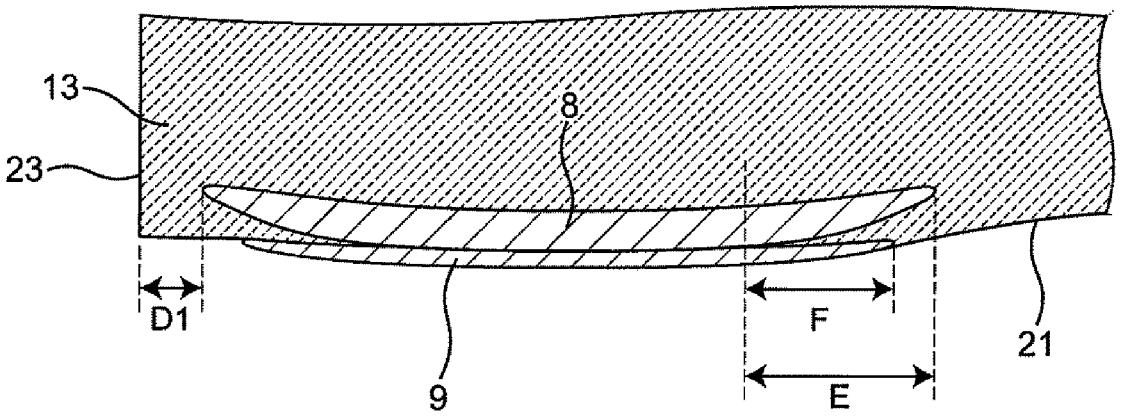
FIG. 8 is an enlarged sectional view of the vicinity of the outer electrode of the multilayer coil component according to the embodiment illustrated in FIG. 1.

According to an embodiment, as illustrated in FIG. 8, the ferrite layer 13 of the body 2 extends on end portions of the underlying electrode 8 across the boundary with the underlying electrode 8. Because the ferrite layer of the body extends onto the underlying electrode, the peeling-off of the underlying electrode can be more inhibited.

The extension distance of the ferrite layer on each of the underlying electrodes 8 may be preferably, but not necessarily, about 10 μm or more and about 90 μm or less (i.e., from about 10 μm to about 90 μm), more preferably about 20 μm and about 80 μm or less (i.e., from about 20 μm to about 80 μm).

The plating layers 9 are disposed on the respective underlying electrodes 8.

According to an embodiment, as illustrated in FIG. 8, the plating layer 9 extends on the ferrite layer across the boundary with the ferrite layer extending on the underlying electrode 8. In other words, at the outer edge portions of the plating layer 9, the ferrite layer is interposed between the plating layer 9 and the underlying electrode 8. The ferrite layer may be a magnetic layer or a non-magnetic layer.

The plating growth distance of the plating layer extending on the ferrite layer may be preferably, but not necessarily, about 5 μm or more and about 60 μm or less (i.e., from about 5 μm to about 60 μm), more preferably about 20 μm or more and about 50 μm or less (i.e., from about 20 μm to about 50 μm). The growth of the plating layer onto the ferrite layer can further inhibit the peeling-off of the underlying electrodes 8.

The side-gap distance, the extension distance, and the plating growth distance can be measured as described below.

As with the case of measuring the depth of the recessed section, a sample of the multilayer coil component is vertically placed. The sample is sealed with a resin in such a manner that an LT side surface, for example, the side surface 22, is exposed.

The sample is polished with a polishing machine to a depth of about ½ of the width of the sample in the W direction to expose an LT section.

The polished surface of the sample is photographed with a scanning electron microscope (SEM).

Distance D1 (FIG. 8) between an end portion of the underlying electrode and a side surface is measured and defined as the side-gap distance.

Distance E (FIG. 8) between an end portion of the underlying electrode and an end portion of the ferrite layer extending on the underlying electrode is measured and defined as the extension distance.

Distance F (FIG. 8) between the end portion of the ferrite layer extending on the underlying electrode and an end portion of the plating layer extending on the ferrite layer is measured and defined as the plating growth distance.

The underlying electrodes 8 may be composed of any conductive material containing a conductive metal and is preferably composed of a conductive material mainly containing Cu or Ag, more preferably a conductive material mainly containing Ag.

According to an embodiment, the underlying electrodes 8 contain a glass component. The underlying electrodes contain glass and thus can have improved adhesion to the body, thus preventing the peeling-off of the underlying electrodes.

Non-limiting examples of the glass component include glasses containing $SiO_2$, $B_2O_3$, $K_2O$, $Li_2O$, CaO, ZnO, $Bi_2O_3$, and/or $Al_2O_3$.

The glass component content may be preferably about 0.8% or more by mass and about 1.2% or less by mass (i.e., from about 0.8% by mass to about 1.2% by mass), more preferably about 0.9% or more by mass and about 1.1% or less by mass (i.e., from about 0.9% by mass to about 1.1% by mass) based on the total of the conductive metal and the glass. A glass component content of about 0.8% or more by mass results in improved adhesion between the underlying electrodes and the body. A glass component content of about 1.2% or less by mass results in improved adhesion between the underlying electrodes and the plating layers.

The plating layers 9 are not particularly limited, but contain at least one of Ni and Sn.

According to an embodiment, the underlying electrodes 8 are composed of Ag, and each of the plating layers 9 includes a Ni layer and a Sn layer.

The lead electrodes 6*a* and 6*b* are electrically connected between the respective end portions of the coil conductor 3 and the respective outer electrodes 5*a* and 5*b*. The lead electrodes may be composed of any conductive material containing a conductive metal and is preferably composed of a conductive material mainly containing Cu or Ag, more preferably a conductive material mainly containing Ag. For example, the lead electrodes are composed of a conductive material having a conductive metal content of about 98.0% by mass to about 99.9% by mass.

According to an embodiment, none of the lead electrodes 6*a* and 6*b* are disposed at inner side portion of the winding section of the coil conductor 3. Because none of the lead electrodes 6*a* and 6*b* are disposed at the inner side portion of the winding section of the coil conductor 3, the multilayer coil component can have increased inductance. Furthermore, the multilayer coil component can have reduced stray capacitance.

According to an embodiment, the lead electrode 6*a* extends through the outer side portion of the winding section of the coil conductor 3 and is connected between the outer electrode 5*a* and the upper end portion of the coil conductor 3. Because the lead electrode extends through the outer side portion of the winding section of the coil conductor 3, the multilayer coil component can have further increased inductance. Furthermore, the multilayer coil component can have further reduced stray capacitance.

In a preferred embodiment, the lead electrode 6*a* is disposed at the outer side portion of the winding section of the coil conductor 3. One end portion of the lead electrode 6*a* is electrically connected to the upper end portion of the coil conductor 3, and the other end thereof is electrically connected to the outer electrode 5*a*. One end portion of the lead electrode 6*b* is electrically connected to the lower end portion of the coil conductor 3, and the other end thereof is electrically connected to the outer electrode 5*b*. A portion of the winding section of the coil conductor 3 facing the lead electrode 6*a* is recessed inward in order to sufficiently achieve a distance from the lead electrode 6*a*. In this portion, the distance between the coil conductor 3 and the lead electrode 6*a* is preferably about 50 μm or more, more preferably about 60 μm or more. The upper limit of the distance between the coil conductor 3 and the lead electrode 6*a* may be, but is not particularly limited to, for example, about 100 μm or less. Non-limiting examples of the shape of the recessed portion include substantially angular shapes and substantially arch shapes.

According to an embodiment, the lead electrode 6*a* has a shape in which a portion thereof close to the coil conductor 3 is cut off or recessed when viewed in plan in the lamination direction. In other words, the lead electrode 6*a* has a cutout portion close to the coil conductor 3 when viewed in plan in the lamination direction. Examples of the shape may include a substantially pentagonal shape in which one corner of a substantially rectangle is cut off, and a shape recessed along the shape of the winding section of the coil conductor 3. Because the lead electrode has the shape in which the portion close to the coil conductor 3 is cut off or recessed, the multilayer coil component has a large distance between the coil conductor and the lead electrode and thus improved reliability.

The lead electrodes 6*a* and 6*b* may be formed in the same way as for the conductive layers 7 and may have the same characteristics as the conductive layers 7. For example, according to an embodiment, the lead electrodes 6*a* and 6*b* may have wedge-shaped recessed portions on side surfaces thereof. The arrangement of the wedge-shaped recessed portions on the side surfaces of the lead electrodes results in low stress, compared with the case where no recessed portion is provided. This can suppress the occurrence of cracking in the body 2.

For example, according to an embodiment, the lead electrodes 6*a* and 6*b* may have a structure in which two types of electrode layers are alternately laminated. The two types of electrode layers may be the same as the first conductive layer 11 and the second conductive layer 12 included in the conductive layers 7.

For example, the multilayer coil component 1 according to this embodiment is produced as described below.

First, a magnetic material is provided. The composition of the magnetic material may preferably contain, but not necessarily, Fe, Zn, Cu, and Ni serving as main components. Typically, the magnetic material may be prepared by mixing $Fe_2O_3$, ZnO, CuO, and NiO powders, serving as raw materials, together in a desired ratio and calcining the mixture. However, the magnetic material is not limited thereto.

According to an embodiment, the main components of the magnetic material are oxides of Fe, Zn, Cu, and Ni (ideally, $Fe_2O_3$, ZnO, CuO, and NiO). The magnetic material may have, in terms of $Fe_2O_3$, an Fe content of about 40.0% or more by mole and about 49.5% or less by mole (i.e., from about 40.0% by mole to about 49.5% by mole) (with respect to the total of the main components, the same is true for the following), preferably about 45.0% or more by mole and about 49.5% or less by mole (i.e., from about 45.0% by mole to about 49.5% by mole).

The magnetic material may have, in terms of ZnO, a Zn content of about 2.0% or more by mole and about 35.0% or less by mole (i.e., from about 2.0% by mole to about 35.0% by mole) (with respect to the total of the main components, the same is true for the following), preferably about 10.0% or more by mole and about 30.0% or less by mole (i.e., from about 10.0% by mole to about 30.0% by mole).

The magnetic material may have, in terms of CuO, a Cu content of about 6.0% or more by mole and about 13.0% or less by mole (i.e., from about 6.0% by mole to about 13.0% by mole) (with respect to the total of the main components, the same is true for the following), preferably about 7.0% or more by mole and about 10.0% or less by mole (i.e., from about 7.0% by mole to about 10.% by mole).

The Ni content of the magnetic material is not particularly limited and may be the balance of Fe, Zn, and Cu serving as the other main components.

Separately, a non-magnetic material is provided. The composition of the non-magnetic material may preferably contain, but not necessarily, Fe, Cu, and Zn serving as main components. Typically, the non-magnetic material may be prepared by mixing $Fe_2O_3$, CuO, and ZnO powders, serving as raw materials, together in a desired ratio and calcining the mixture. However, the non-magnetic material is not limited thereto.

The non-magnetic material may have, in terms of $Fe_2O_3$, an Fe content of about 40.0% or more by mole and about 49.5% or less by mole (i.e., from about 40.0% by mole to about 49.5% by mole) (with respect to the total of the main components, the same is true for the following), preferably about 45.0% or more by mole and about 49.5% or less by mole (i.e., from about 45.0% by mole to about 49.5% by mole).

The non-magnetic material may have, in terms of CuO, a Cu content of about 6.0% or more by mole and about 12.0% or less by mole (i.e., from about 6.0% by mole to about 12.0% by mole) (with respect to the total of the main components, the same is true for the following), preferably about 7.0% or more by mole and about 10.0% or less by mole (i.e., from about 7.0% by mole to about 10.0% by mole).

The Zn content of non-magnetic material in terms of ZnO is not particularly limited and may be the balance of Fe and Cu serving as the other main components.

In this disclosure, the magnetic material and the non-magnetic material (hereinafter, also referred collectively as "ferrite materials") may further contain an additive component. Non-limiting examples of the additive components for the ferrite materials include Mn, Co, Sn, Bi, and Si. The Mn, Co, Sn, Bi, and Si contents (amounts added) are, in terms of $Mn_3O_4$, $Co_3O_4$, $SnO_2$, $Bi_2O_3$, and $SiO_2$, respectively, preferably about 0.1 parts by weight or more and about 1 part by weight or less with respect to 100 parts by weight (i.e., from about 0.1 parts by weight to about 1 part by weight) of the total of the main components, i.e., Fe (in terms of $Fe_2O_3$), Zn (in terms of ZnO), Cu (in terms of CuO), and Ni (in terms of NiO).

Regarding before and after sintering of the magnetic material into a magnetic layer and before and after sintering of the non-magnetic material into a non-magnetic layer, for example, CuO and $Fe_2O_3$ in the magnetic and non-magnetic materials before sintering may be partially changed into $Cu_2O$ and $Fe_3O_4$, respectively, by firing. However, it is safe to assume that the contents of the main components in the magnetic layer and the non-magnetic layer after sintering are substantially equal to the contents of the main components in the magnetic material and the non-magnetic material before sintering. Specifically, for example, it is safe to assume that the Cu content in terms of CuO and the Fe content in terms of $Fe_2O_3$ after sintering are substantially equal to the CuO content and the $Fe_2O_3$ content, respectively, before sintering.

The magnetic material and the non-magnetic material may contain unavoidable impurities.

A magnetic paste is provided using the magnetic material. For example, the magnetic paste may be prepared by mixing, kneading, and dispersing the magnetic material with a binder resin such as polyvinyl acetal, an organic solvent such as a ketone-based solvent, and a plasticizer such as an alkyd-based plasticizer. However, the magnetic paste is not limited thereto. Similarly, a non-magnetic paste is provided using the non-magnetic material in place of the magnetic material.

Separately, a conductive paste for the conductive layers and the lead electrodes is provided. For example, the conductive paste is, but not particularly limited to, a paste containing Ag or Cu, preferably a paste containing Ag. For example, the conductive paste may be prepared by mixing, kneading, and dispersing Ag with a binder resin such as ethyl cellulose, an organic solvent such as eugenol, and a dispersant. However, the conductive paste is not limited thereto. A common, commercially available copper or silver paste containing a Cu or Ag powder may be used.

According to an embodiment, two types of conductive pastes are provided. Specifically, two types of conductive pastes having different shrinkages during firing are provided.

According to an embodiment, a conductive paste having a relatively low shrinkage of, for example, about 10% or more and about 15% or less (i.e., from about 10% to about 15%) is used as a first conductive paste. A conductive paste having a relatively high shrinkage of, for example, about 20% or more and about 25% or less (i.e., from about 20% to about 25%) is used as a second conductive paste.

The shrinkage can be adjusted by changing a pigment volume concentration (PVC), which is a volume concentration of a conductive powder with respect to the total volume of the conductive powder and a resin component. The use of the two types of conductive pastes having different shrinkages can form layers having different thicknesses after sintering.

The shrinkage can be determined as follows: A conductive paste is applied to a polyethylene terephthalate (PET) film, dried, and cut into a sample measuring 5 mm×5 mm. Then changes in sample dimensions are measured with a thermomechanical analyzer (TMA).

A conductive paste for the underlying electrodes is provided. For example, the conductive paste for the underlying electrodes is, but not particularly limited to, a paste containing a conductive metal such as Ag or Cu, preferably a paste containing Ag. As the conductive paste for the underlying electrodes, a paste further containing glass is preferred. For example, the conductive paste may be prepared by mixing, kneading, and dispersing Ag and glass with a binder resin such as ethyl cellulose, an organic solvent such as eugenol, and a dispersant. However, the conductive paste is not limited thereto.

When the conductive paste for the underlying electrodes contains glass, the glass content may be preferably about 0.8% or more by mass and about 1.2% or less by mass (i.e., from about 0.8% by mass to about 1.2% by mass), more preferably about 0.9% or more by mass and about 1.1% or less by mass (i.e., from about 0.9% by mass to about 1.1% by mass) with respect to the total of the conductive metal and the glass.

Next, a multilayer body is formed using the magnetic paste, the non-magnetic paste, and the conductive pastes. The formation of the multilayer body will be described below with reference to FIGS. 9A to 10D.

In this embodiment, the formation is started from an upper surface 26 (upper surface in FIG. 4). While one multilayer body is illustrated in FIGS. 9A to 9K, a collection of multilayer bodies can be formed on a sheet.

The magnetic paste is formed into a sheet, thereby providing a magnetic sheet.

Figure 9A:
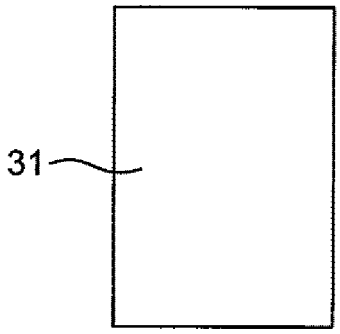
FIGS. 9A and 9B are explanatory views illustrating a method for producing the multilayer coil component according to the embodiment illustrated in FIG. 1 and illustrate the stacking order and the shape of layers.
Figure 10A:
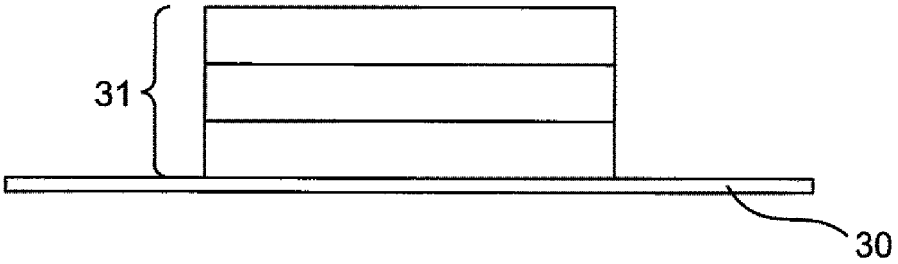
FIGS. 10A to 10D are explanatory views illustrating the method for producing the multilayer coil component according to the embodiment illustrated in FIG. 1 and illustrate the cross-sectional shape of a portion of the coil conductor.

A thermal release sheet and a polyethylene terephthalate (PET) film are stacked on a metal plate. The magnetic sheet is preliminarily pressure-bonded thereto, thereby forming a stacked magnetic sheet 31 (FIGS. 9A and 10A). This layer corresponds to an outer layer of a multilayer coil component.

Figure 9B:
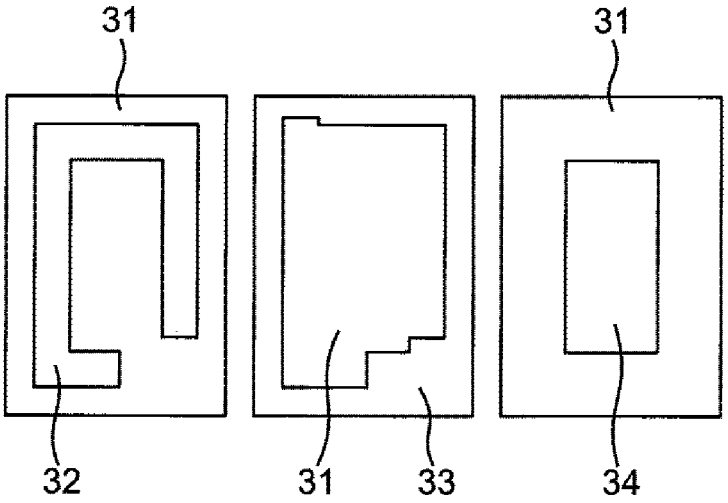
Figure 10B:
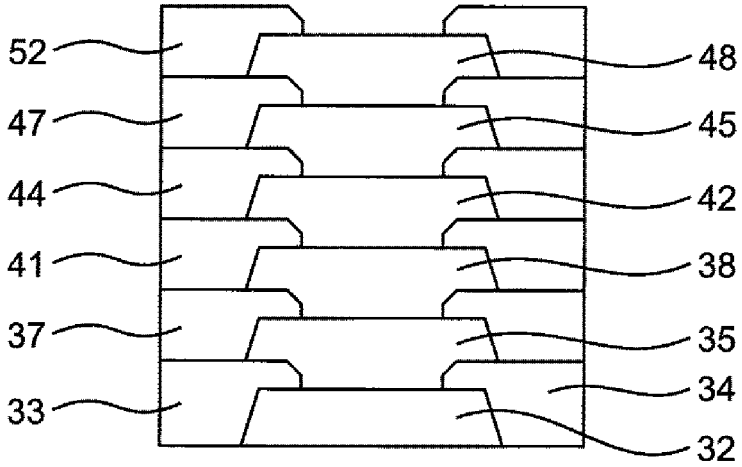

A first conductive paste layer 32 is formed on the stacked magnetic sheet 31 using the first conductive paste. A non-magnetic paste layer 33 is formed on the outer side portion of the first conductive paste layer 32 using the non-magnetic paste so as to overlap the first conductive paste layer 32. A magnetic paste layer 34 is formed at the inner side portion of the first conductive paste layer 32 using the magnetic paste so as to overlap the first conductive paste layer 32 (FIGS. 9B and 10B). These layers can be formed by a known method such as screen printing.

Figure 9C:
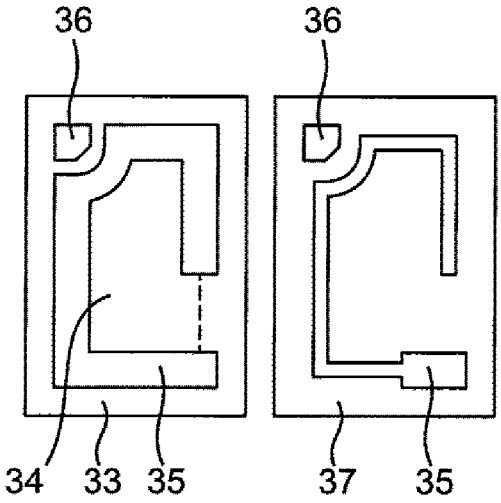
FIGS. 9C and 9D are explanatory views illustrating the method for producing the multilayer coil component according to the embodiment illustrated in FIG. 1 and illustrate the stacking order and the shape of layers.

A second conductive paste layer 35 is formed on the first conductive paste layer 32. The non-magnetic paste layer 33 is interposed at the outer edge portion of a region where the first conductive paste layer 32 and the second conductive paste layer 35 overlap each other. Simultaneously, a second conductive paste layer 36 for lead electrodes are formed. A magnetic paste layer 37 is formed thereon in such a manner that the second conductive paste layers 35 and 36 are exposed (FIGS. 9C and 10B). The first conductive paste layer 32 and the second conductive paste layer 35 correspond to the uppermost conductive layer 7 illustrated in FIG. 4. The non-magnetic paste layer 33 corresponds to the non-magnetic layer 14 located at the outer side portion of the winding section 4.

Figure 9D:
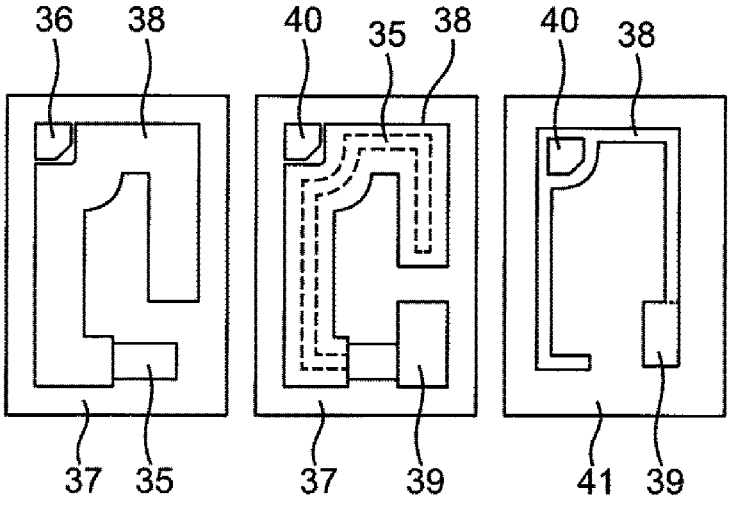

A non-magnetic paste layer 38 is formed so as to cover the exposed second conductive paste layer 35. First conductive paste layers 39 and 40 are formed on the second conductive paste layers 35 and 36. A magnetic paste layer 41 is formed thereon in such a manner that the first conductive paste layers 39 and 40 and the non-magnetic paste layer 38 are exposed (FIGS. 9D and 10B). The non-magnetic paste layer 38 corresponds to one of the non-magnetic layers 14 disposed between the conductive layers 7 illustrated in FIG. 4.

First conductive paste layers 42 and 43 are formed so as to cover the non-magnetic paste layer 38 and the first conductive paste layer 40 exposed through openings in the magnetic paste layer 41. A magnetic paste layer 44 is formed thereon in such a manner that the first conductive paste layers 42 and 43 are exposed (FIGS. 9E and 10B).

Second conductive paste layers 45 and 46 are formed so as to cover the first conductive paste layers 42 and 43 exposed through openings in the magnetic paste layer 44. A magnetic paste layer 47 is formed thereon in such a manner that the second conductive paste layers 45 and 46 are exposed (FIGS. 9F and 10B).

A non-magnetic paste layer 48 is formed so as to overlap the second conductive paste layers 45 and 46 exposed through openings in the magnetic paste layer 47. First conductive paste layers 50 and 51 are formed on the second conductive paste layers 45 and 46. A magnetic paste layer 52 is formed thereon in such a manner that the first conductive paste layers 50 and 51 and the non-magnetic paste layer 48 are exposed (FIGS. 9G and 10B).

Figure 9E:
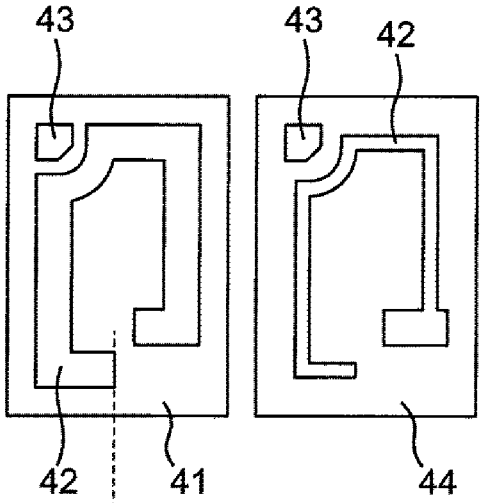
FIGS. 9E to 9G are explanatory views illustrating the method for producing the multilayer coil component according to the embodiment illustrated in FIG. 1 and illustrate the stacking order and the shape of layers.
Figure 9F:
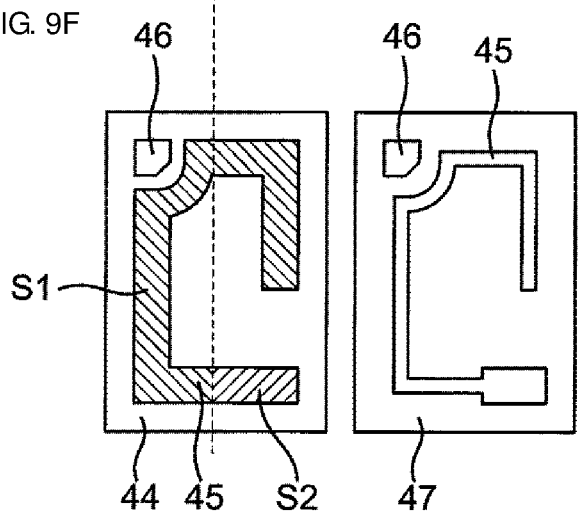
Figure 9G:
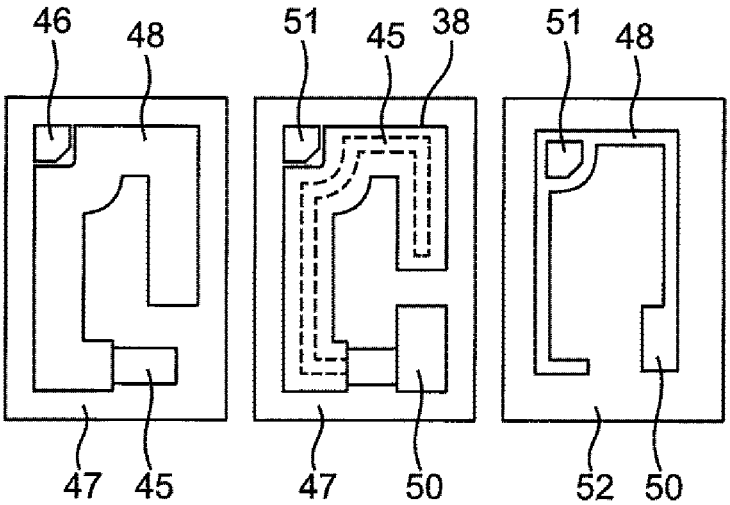

The winding section of the coil conductor 3 is formed by repeating the steps illustrated in FIGS. 9E to 9G a predetermined number of times.

The first conductive paste layer 42 includes an overlapping portion Si that overlaps with the second conductive paste layer 45 and a non-overlapping portion S2 that does not overlap with the second conductive paste layer 45 when viewed in plan, and the second conductive paste layer 45 includes an overlapping portion S1 that overlaps with the first conductive paste layer 42 and a non-overlapping portion S2 that does not overlap with the first conductive paste layer 42 when viewed in plan. A first conductive paste layer 50 (connection conductor paste layer) is formed on the non-overlapping portion of the second conductive paste layer 45 in order to connect the second conductive paste layer 45 to a first conductive paste layer to be subsequently formed.

Figure 9H:
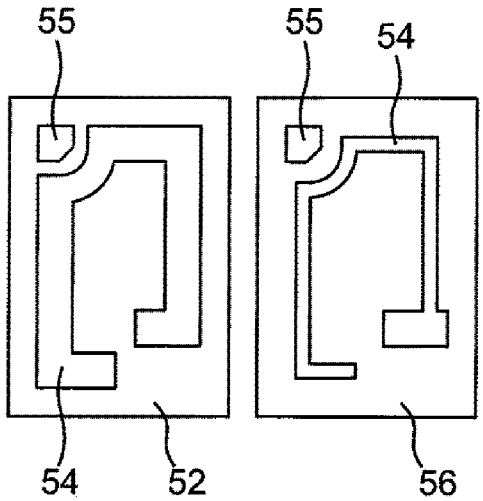
FIGS. 9H and 9I are explanatory views illustrating the method for producing the multilayer coil component according to the embodiment illustrated in FIG. 1 and illustrate the stacking order and the shape of layers.
Figure 10C:
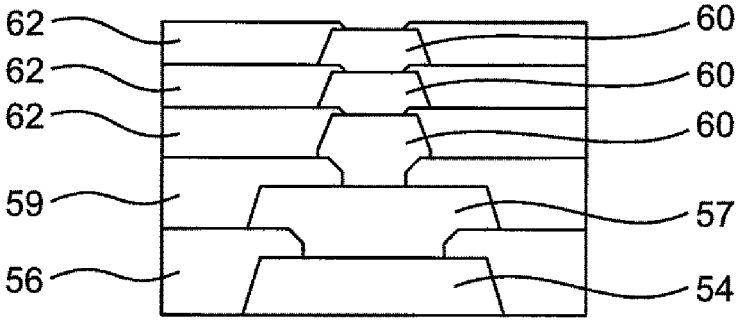

First conductive paste layers 54 and 55 are formed on the non-magnetic paste layer 48 and the first conductive paste layers 50 and 51 exposed through openings in the magnetic paste layer 52. A magnetic paste layer 56 is formed thereon in such a manner that the first conductive paste layers 54 and 55 are exposed (FIGS. 9H and 10C).

Figure 9I:
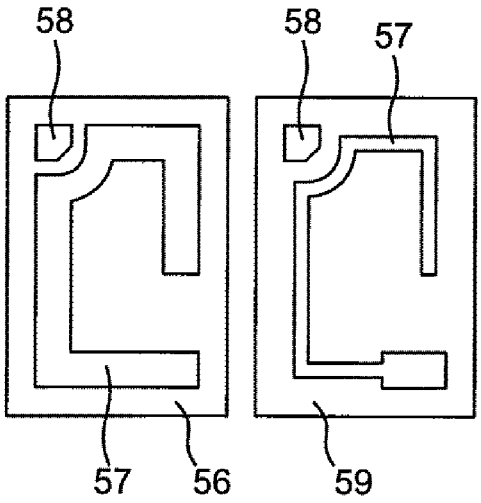

Second conductive paste layers 57 and 58 are formed so as to cover the first conductive paste layers 54 and 55 exposed through an opening in the magnetic paste layer 56. A magnetic paste layer 59 is formed thereon in such a manner that the second conductive paste layers 57 and 58 are exposed (FIGS. 9I and 10C).

Figure 9J:
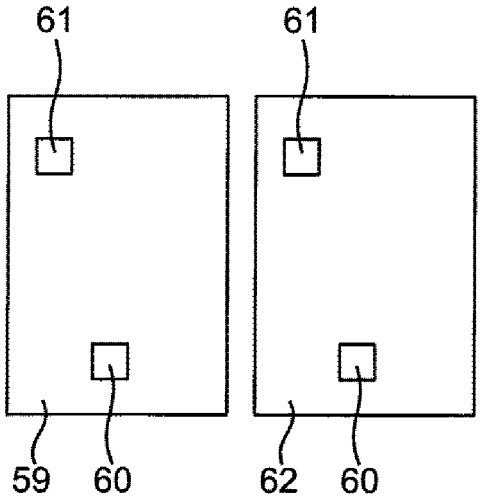
FIGS. 9J and 9K are explanatory views illustrating the method for producing the multilayer coil component according to the embodiment illustrated in FIG. 1 and illustrate the stacking order and the shape of layers.
Figure 10D:
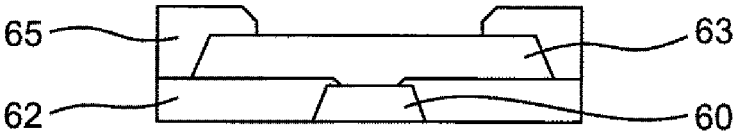

Conductive paste layers 60 and 61 are formed so as to cover the second conductive paste layers 57 and 58 exposed through openings in the magnetic paste layer 59. A magnetic paste layer 62 is formed on a portion other than portions where the conductive paste layers 60 and 61 are formed (FIGS. 9J and 10D). The formation of the conductive paste layers 60 and 61 and the magnetic paste layer 62 is repeated a predetermined number of times to form lead electrodes and a lower exterior. As the conductive paste layers 60 and 61, the first conductive paste layer and the second conductive paste layer are alternately used.

Figure 9K:
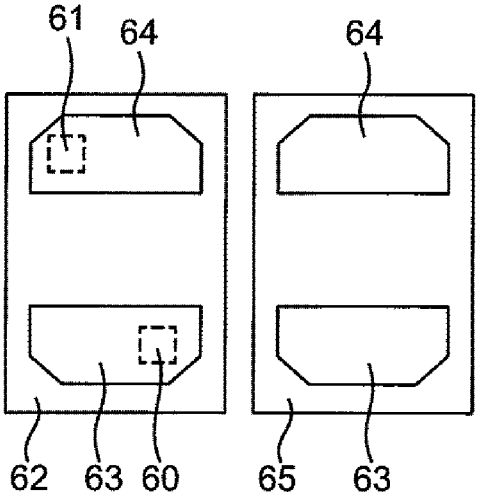

Underlying electrodes 63 and 64 are formed so as to be connected to the conductive paste layers 60 and 61, respectively. A magnetic paste layer 65 is formed around the underlying electrodes 63 and 64 (FIG. 9K).

Articles formed by printing through the steps illustrated in FIGS. 9A to 9K are detached from the metal plate by heating. The articles are subjected to pressure bonding (main pressure bonding). Removal of the PET film results in a collection of elements.

The resulting collection of the elements is separated into individual elements. A method for separating the collection into individual elements is not particularly limited. For example, the separation can be performed with a dicing machine.

The resulting elements are subjected to barrel processing to round the corners of the elements. The barrel processing may be performed for unfired or fired multilayer bodies. The barrel processing may be either wet or dry. The barrel processing may be a method in which the elements are rubbed against each other or a method in which barrel processing is performed with media.

The elements are fired. The firing temperature may be, for example, about 800° C. or higher and about 1,000° C. or lower (i.e., from about 800° C. to about 1,000° C.), preferably about 880° C. or higher and about 920° C. or lower (i.e., from about 880° C. to about 920° C.).

After the firing, plating layers are formed on the underlying electrodes 63 and 64.

A plating method may be electroplating treatment or electroless plating treatment. Preferably, electroplating treatment is used.

In this way, the multilayer coil component 1 according to the embodiment is produced.

While the magnetic paste and the non-magnetic paste (hereinafter, also referred to collectively as a "ferrite paste") are both used in this embodiment, the present disclosure is not limited thereto. In the present disclosure, the ferrite paste layer may be formed using the ferrite paste. For example, only the magnetic paste may be used.

While the embodiments of the present disclosure are described above, the present disclosure is not limited to these embodiments, and various modifications can be made.

EXAMPLES

Magnetic Paste

To prepare a magnetic material, $Fe_2O_3$, ZnO, CuO, and NiO were weighed so as to achieve proportions described below.

$Fe_2O_3$: about 48.0% by mole

ZnO: about 25.0% by mole

CuO: about 9.0% by mole

NiO: balance

The weighed substances were placed in a pot mill composed of vinyl chloride together with deionized water and partially stabilized zirconia (PSZ) balls. The mixture was sufficiently mixed and pulverized by a wet process. The pulverized mixture was evaporated to dryness. The dry mixture was calcined at about 750° C. for about 2 hours. The resulting calcined powder was kneaded with predetermined amounts of a ketone-based solvent, polyvinyl acetal, and an alkyd-based plasticizer using a planetary mixer and dispersed using a three-roll mill to prepare a magnetic paste.

Non-Magnetic Paste

To prepare a non-magnetic material, $Fe_2O_3$, CuO, and ZnO were weighed so as to achieve proportions as described below.

$Fe_2O_3$: about 48.0% by mole

CuO: about 9.0% by mole

ZnO: balance

The weighed substances were placed in a pot mill composed of vinyl chloride together with deionized water and partially stabilized zirconia (PSZ) balls. The mixture was sufficiently mixed and pulverized by a wet process. The pulverized mixture was evaporated to dryness. The dry mixture was calcined at about 750° C. for about 2 hours. The resulting calcined powder was kneaded with predetermined amounts of a ketone-based solvent, polyvinyl acetal, and an alkyd-based plasticizer using a planetary mixer and dispersed using a three-roll mill to prepare a non-magnetic paste.

Conductive Paste

As conductive pastes for a coil conductor, two types of conductive pastes having different shrinkages during firing were provided. Silver was used as a conductive material. The shrinkage was adjusted by changing a pigment volume concentration (PVC).

Conductive paste 1: a shrinkage of about 12%

Conductive paste 2: a shrinkage of about 22%

Paste for Underlying Electrode

As a paste for underlying electrodes, a silver paste containing about 1.0% by mass of a glass component was provided.

A multilayer body was produced in the same way as in the foregoing embodiment using the magnetic paste, the non-magnetic paste, the conductive paste 1, and the conductive paste 2 (FIGS. 9A to 9K). The resulting multilayer body was placed in a furnace, sufficiently debindered by heating to about 400° C., and fired by holding the multilayer body at about 900° C. for about 5 hours in air.

After firing, a layer of Ni plating and a layer of Sn plating were formed on the underlying electrodes by electroless plating, thereby providing a multilayer coil component of this example.

Comparative Example

A multilayer coil component of a comparative example was produced as in the example, except that only the conductive paste 2 (a shrinkage of about 22%) was used as a conductive paste and that the conductive paste 2 was applied twice.

Evaluation

Three multilayer coil components of each of the example and the comparative example were evaluated as described below.

Dimension of Recessed Section

Samples of the multilayer coil components were vertically placed. Each sample was sealed with a resin in such a manner that an LT side surface was exposed. The sample was polished with a polishing machine to a depth of about ½ of the width of the sample in the W direction to expose an LT section. To remove sags of the inner conductors due to polishing, after the polishing was completed, the polished surface was processed by ion milling with an ion milling system (Model: IM4000, available from Hitachi High-Technologies Corporation).

The polished surface of the sample was photographed with a scanning electron microscope (SEM). Line connecting lower portions of two outer electrodes was drawn. The largest distance between the line and the lower surface of the body was measured. The average of the three samples was defined as the depth of the recessed section. The recessed section of each sample of the example had a depth of about 0.040 mm. The samples of the comparative example had no recessed section.

Next, 30 samples of each of the example and the comparative example were mounted with solder on a glass epoxy substrate including land electrodes. The periphery of the substrate was surrounded by a frame. An epoxy resin was poured thereinto. The epoxy resin was cured while being subjected to vacuum defoaming.

Then 30 samples of the multilayer coil components of each of the examples and the comparative example were cut with a dicing machine at the substantially central portions thereof. The cut surfaces were observed under an optical microscope to determine the number of samples in which the epoxy resin did not sufficiently enter portions of the lower surfaces to form gaps between the components and the substrate. In the samples of the example, the number of samples in which the gaps were formed was zero, whereas in the samples of the comparative example, the number of samples in which the gaps were formed was 12.

The present disclosure includes, but is not limited to, the following aspects.

1. A multilayer coil component includes a body including laminated ferrite layers, a coil conductor including conductive layers laminated in the body, and a pair of outer electrodes disposed on the lower surface of the body. Each of the pair of outer electrodes is electrically connected to a corresponding one of the end portions of the coil conductor, in which the lower surface of the multilayer coil component includes a recessed section between the pair of outer electrodes.

2. In the multilayer coil component according to aspect 1, the upper end portion of the coil conductor is electrically connected to one of the pair of outer electrodes through a lead electrode disposed at an outer side portion of the winding section of the coil conductor.

3. In the multilayer coil component according to aspect 1 or 2, the ferrite layers are magnetic layers, or a magnetic layer and a non-magnetic layer.

4. In the multilayer coil component according to aspect 3, the non-magnetic layer is disposed between the conductive layers.

5. In the multilayer coil component according to aspect 3 or 4, the non-magnetic layer is disposed at the outer side portion of the winding section of the coil conductor.

6. In the multilayer coil component according to any one of aspects 3 to 5, the inner side portion of the winding section of the coil conductor is occupied by the magnetic layer.

7. In the multilayer coil component according to any one of aspects 1 to 6, the recessed section has a depth of about 0.01 mm or more and about 0.10 mm or less (i.e., from about 0.01 mm to about 0.10 mm).

8. In the multilayer coil component according to any one of aspects 1 to 7, the recessed section has a tapered portion having a taper angle of about 3° or more and about 10° or less (i.e., from about 3° to about 10°).

9. A method for producing a multilayer coil component including a body including laminated ferrite layers, a coil conductor including conductive layers laminated in the body, the conductive layers being connected through a connection conductor, and a pair of outer electrodes disposed on the lower surface of the body. Each of the pair of outer electrodes is electrically connected to a corresponding one of end portions of the coil conductor. The method further includes forming a first conductive paste layer with a first conductive paste and forming a second conductive paste layer with a second conductive paste on the first conductive paste layer to form a stacked conductive paste layer in which the first conductive paste layer and the second conductive paste layer are stacked, forming a ferrite paste layer with a ferrite paste on the conductive paste layer, and forming another first conductive paste layer with the first conductive paste on the ferrite paste layer and forming another second conductive paste layer with the second conductive paste on the another first conductive paste layer to form another stacked conductive paste layer in which the another first conductive paste layer and the another second conductive paste layer are stacked, in which the first conductive paste and the second conductive paste have different shrinkages when fired.

10. In the method according to aspect 9, the first conductive paste has a lower shrinkage than the second conductive paste.

11. In the method according to aspect 9 or 10, regarding the stacked conductive paste layer, the first conductive paste layer includes an overlapping portion that overlaps with the second conductive paste layer and a non-overlapping portion that does not overlap with the second conductive paste layer when viewed in plan, and the second conductive paste layer includes an overlapping portion that overlaps with the first conductive paste layer and a non-overlapping portion that does not overlap with the first conductive paste layer when viewed in plan.

12. The method according to aspect 11 further includes forming a connection conductor paste layer on the non-overlapping portion of the second conductive paste layer, the connection conductor paste layer being configured to connect the second conductive paste layer to the another first conductive paste layer of the another stacked conductive paste layer.

The multilayer coil component provided by the present disclosure can be used for various applications, for example, in various electronic devices.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a body including laminated ferrite layers;

a coil conductor including conductive layers laminated in the body; and a pair of outer electrodes disposed on a lower surface of the body, each of the pair of outer electrodes being electrically connected to a corresponding one of end portions of the coil conductor, wherein the lower surface of the multilayer coil component includes a recessed section between the pair of outer electrodes, each of the outer electrodes includes an underlying electrode, and one of the ferrite layers extends on end portions of the underlying electrodes across boundaries with the underlying electrodes on both sides in a vertical direction.

2. The multilayer coil component according to claim 1, wherein an upper end portion of the coil conductor is electrically connected to one of the pair of outer electrodes through a lead electrode disposed at an outer side portion of a winding section of the coil conductor.

3. The multilayer coil component according to claim 1, wherein the ferrite layers are magnetic layers, or a magnetic layer and a non-magnetic layer.

4. The multilayer coil component according to claim 3, wherein each of the non-magnetic layers is disposed between respective conductive layers of the plurality of conductive layers.

5. The multilayer coil component according to claim 3, wherein one of the non-magnetic layers is disposed at an outer side portion of a winding section of the coil conductor.

6. The multilayer coil component according to claim 3, wherein an inner side portion of a winding section of the coil conductor is occupied by the magnetic layers.

7. The multilayer coil component according to claim 1, wherein the recessed section has a depth of from 0.01 mm to 0.10 mm.

8. The multilayer coil component according to claim 1, wherein the recessed section has a tapered portion having a taper angle of from 3° to 10°.

9. The multilayer coil component according to claim 2, wherein the ferrite layers are magnetic layers, or a magnetic layer and a non-magnetic layer.

10. The multilayer coil component according to claim 4, wherein one of the non-magnetic layers is disposed at an outer side portion of a winding section of the coil conductor.

11. The multilayer coil component according to claim 4, wherein an inner side portion of a winding section of the coil conductor is occupied by the magnetic layers.

12. The multilayer coil component according to claim 5, wherein an inner side portion of a winding section of the coil conductor is occupied by the magnetic layers.

13. The multilayer coil component according to claim 2, wherein the recessed section has a depth of from 0.01 mm to 0.10 mm.

14. The multilayer coil component according to claim 3, wherein the recessed section has a depth of from 0.01 mm to 0.10 mm.

15. The multilayer coil component according to claim 2, wherein the recessed section has a tapered portion having a taper angle of from 3° to 10°.

16. The multilayer coil component according to claim 1, wherein at least one of the conductive layers has a constricted portion at an end portion thereof.

17. The multilayer coil component according to claim 1, wherein each of the conductive layers is formed of a first conductive layer and a second conductive layer which is thinner than the first conductive layer.

18. The multilayer coil component according to claim 17, wherein the first conductive layer has a higher pore area percentage than the second conductive layer.

19. The multilayer coil component according to claim 17, wherein at least one of the first conductive layer and the second conductive layer is curved in an arc shape.

* * * * *